US009049973B1

(12) United States Patent
Arrieta

(10) Patent No.: US 9,049,973 B1
(45) Date of Patent: Jun. 9, 2015

(54) ANTI-MICROBIAL SPONGE DEVICE

(71) Applicant: Alain Arrieta, Fort Myers, FL (US)

(72) Inventor: Alain Arrieta, Fort Myers, FL (US)

( * ) Notice: Subject to any disclaimer, the term of this patent is extended or adjusted under 35 U.S.C. 154(b) by 0 days.

(21) Appl. No.: 13/895,770

(22) Filed: May 16, 2013

(51) Int. Cl.
*A46B 5/02* (2006.01)
*A47L 13/16* (2006.01)
*A47L 13/17* (2006.01)

(52) U.S. Cl.
CPC ..... *A47L 13/16* (2013.01); *A47L 13/17* (2013.01); *A46B 5/021* (2013.01)

(58) Field of Classification Search
CPC ..... A47K 7/02; A47L 13/16; A47L 13/17; A46B 5/00; A46B 5/02; A46B 5/021
USPC ..... 15/244.1, 244.3, 244.4
See application file for complete search history.

(56) References Cited

U.S. PATENT DOCUMENTS

| | | | | |
|---|---|---|---|---|
| 3,707,012 | A * | 12/1972 | Lane | 15/104.93 |
| 6,276,023 | B1 | 8/2001 | Grundy | |
| 6,685,376 | B2 * | 2/2004 | Weihrauch | 401/196 |
| 8,065,773 | B2 | 11/2011 | Vaillancourt et al. | |
| 8,336,151 | B2 * | 12/2012 | Kerr et al. | 15/104.94 |
| 2003/0028985 | A1 * | 2/2003 | Prodoehl et al. | 15/118 |
| 2003/0196287 | A1 | 10/2003 | Chen | |
| 2007/0000081 | A1 | 1/2007 | Cotto | |

* cited by examiner

*Primary Examiner* — Randall Chin

(57) ABSTRACT

An anti-microbial sponge device provides an ergonomic gripping surface while also resisting the accumulation of microbial agents thereon. The device includes a gripping surface having a top side, a bottom side, and a perimeter wall extending between the top side and the bottom side. The perimeter wall comprises a front side opposite a back side, and a pair of opposed lateral sides extending between the front side and the back side. Each of the lateral sides is concavely arcuate. Each of the top side, the front side, and the back side is convexly arcuate. A sponge surface is coupled to the gripping surface. The sponge surface extends outwardly from the bottom side of the gripping surface. The sponge surface comprises a porous material. The sponge surface is non-absorbent wherein the sponge surface is configured to resist an accumulation of microbial agents thereon.

9 Claims, 3 Drawing Sheets

ANTI-MICROBIAL SPONGE DEVICE

FIELD OF THE DISCLOSURE

The disclosure relates to sponge devices and more particularly pertains to a new sponge device for providing an ergonomic gripping surface while also resisting the accumulation of microbial agents thereon.

SUMMARY OF THE DISCLOSURE

An embodiment of the disclosure meets the needs presented above by generally comprising a gripping surface having a top side, a bottom side, and a perimeter wall extending between the top side and the bottom side. The perimeter wall comprises a front side opposite a back side, and a pair of opposed lateral sides extending between the front side and the back side. Each of the lateral sides is concavely arcuate. Each of the top side, the front side, and the back side is convexly arcuate. A sponge surface is coupled to the gripping surface. The sponge surface extends outwardly from the bottom side of the gripping surface. The sponge surface comprises a porous material. The sponge surface is non-absorbent wherein the sponge surface is configured to resist an accumulation of microbial agents thereon.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
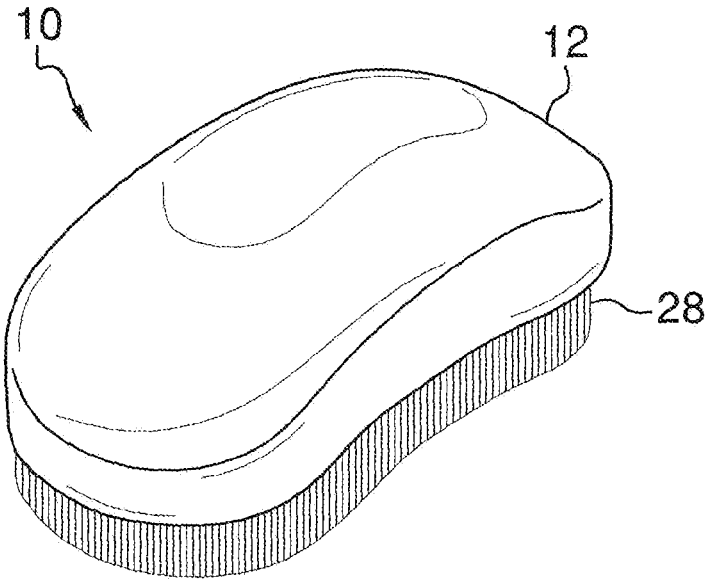
FIG. 1 is a top front side perspective view of an anti-microbial sponge device according to an embodiment of the disclosure.
Figure 2:
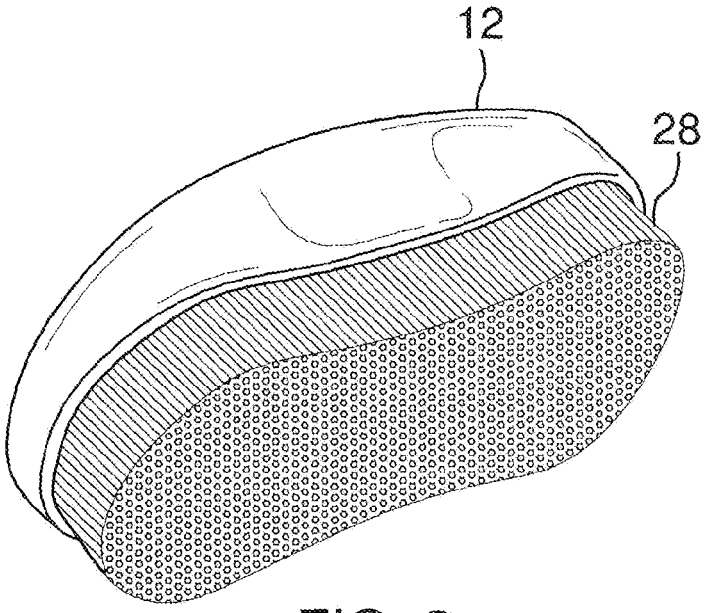
FIG. 2 is a bottom front side perspective view of an embodiment of the disclosure.
Figure 3:
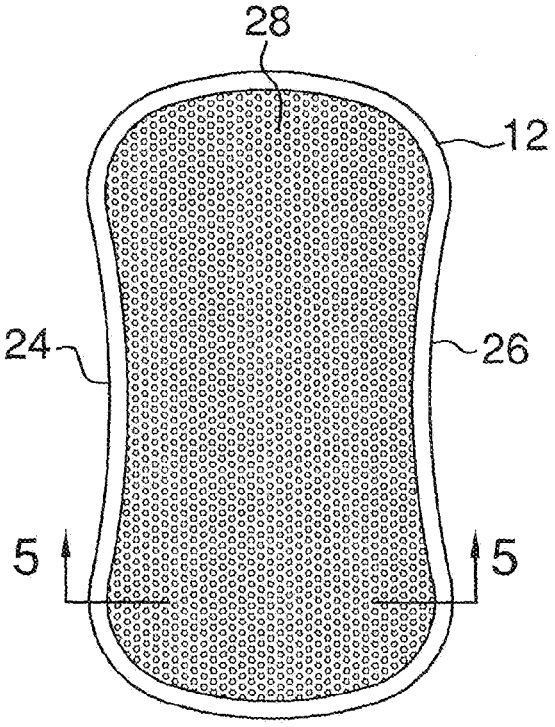
FIG. 3 is a bottom view of an embodiment of the disclosure.
Figure 4:
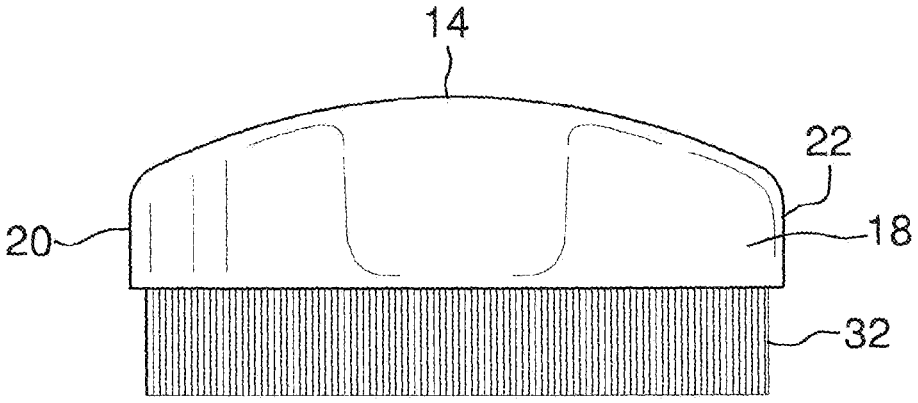
FIG. 4 is a side view of an embodiment of the disclosure.
Figure 5:
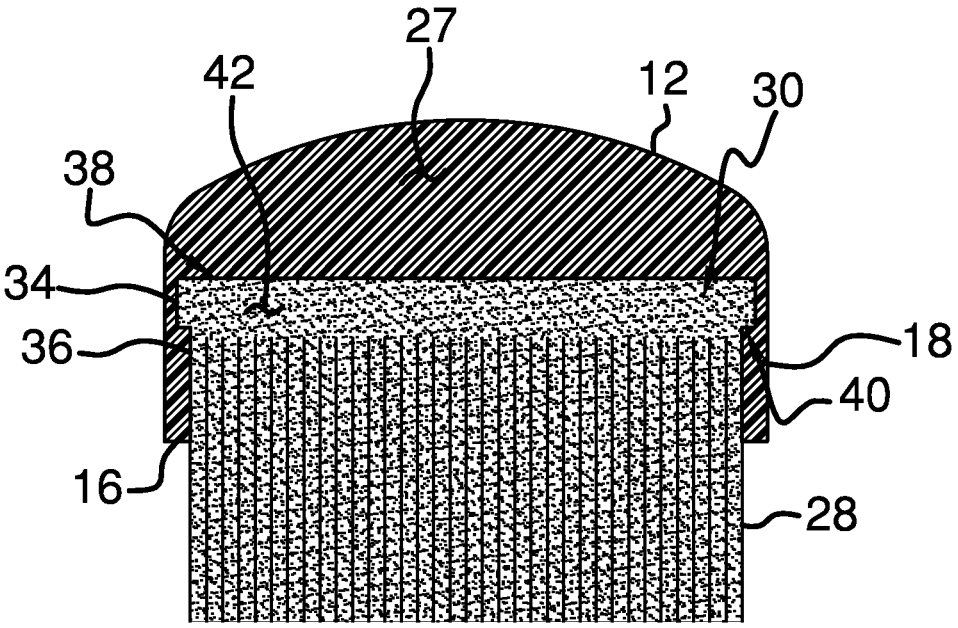
FIG. 5 is a cross-sectional view of an embodiment of the disclosure taken along line 5-5 of FIG. 3.

With reference now to the drawings, and in particular to FIGS. 1 through 5 thereof, a new sponge device embodying the principles and concepts of an embodiment of the disclosure and generally designated by the reference numeral 10 will be described.

As best illustrated in FIGS. 1 through 5, the anti-microbial sponge device 10 generally comprises a gripping surface 12 having a top side 14, a bottom side 16, and a perimeter wall 18 extending between the top side 14 and the bottom side 16. The perimeter wall 18 comprises a front side 20 opposite a back side 22, and a pair of opposed lateral sides 24, 26 extending between the front side 20 and the back side 22. Each of the lateral sides 24, 26 is concavely arcuate. Each of the top side 14, the front side 20, and the back side 22 is convexly arcuate. The shape of the gripping surface 12 provides an ergonomic grip for the user that is well suited to the shape of a human hand. The gripping surface 12 is shaped to resemble a computer mouse. The gripping surface 12 may be made of a translucent gel 27 or similar material.

A sponge surface 28 is coupled to the gripping surface 12. The sponge surface 28 comprises an upper portion 30 and a lower portion 32. The upper portion 30 is housed within the gripping surface 12. The lower portion 32 extends outwardly from the bottom side 16 of the gripping surface 12. The lower portion 32 preferably has a uniform length between the lateral sides 24, 26 of the gripping surface 12. The upper portion 30 has a top section 34 and a bottom section 36. The top section 34 is defined by an upper edge 38 and a lower edge 40. Each of the upper 38 and lower 40 edges is parallel to the bottom side 16 of the gripping surface 12. Each of the top 34 and bottom 36 sections may be spaced from the front 20 and back 22 sides of the gripping surface 12. The bottom section 36 is preferably spaced a greater distance from each of the front 20 and back 22 sides relative to the top section 34. The perimeter wall 18 of the gripping surface 12 may project outwardly a uniform distance around an entirety of the sponge surface 28. The sponge surface 28 comprises a porous material. The sponge surface 28 is comprised of a non-absorbent material 42 wherein the sponge surface 28 is configured to resist an accumulation of microbial agents, such as germs, bacteria, and the like, thereon. In this manner, the sponge surface 28 is more sanitary and lasts longer than conventional sponges. Additionally, the sponge surface 28 does not emit unpleasant odors or present unsanitary and/or unsightly environments. Thus, to achieve these objectives, the sponge surface 28 may be comprised of rubber or similar material.

The device 10 has a height between approximately 4.0 centimeters and 8.0 centimeters; a length between approximately 8.0 centimeters and 17.0 centimeters; and a width between approximately 4.0 centimeters and 8.0 centimeters.

In use, as stated above and shown in the Figures, the user grips the gripping surface 12 and uses the sponge surface 28 to scrub an external surface in the conventional manner. By virtue of the material the scrubbing surface 28 is comprised of, e.g., rubber, the device 10 will be more sanitary and needs to be replaced less often than conventional sponges.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure, in this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An anti-microbial sponge device comprising:

a gripping surface, said gripping surface having a top side, a bottom side, and a perimeter wall extending between said top side and said bottom side, said perimeter wall comprising a front side opposite a back side, and a pair of opposed lateral sides extending between said front side and said back side, each of said lateral sides being concavely arcuate, each of said top side, said front side, and said back side being convexly arcuate, said gripping surface being translucent; and a sponge surface coupled to said gripping surface, said sponge surface extending outwardly from said bottom side of said gripping surface, said sponge surface comprising a porous material, said sponge surface being comprised of a non-absorbent material wherein said sponge surface is configured to resist an accumulation of microbial agents thereon.

2. The device of claim 1, further comprising said sponge surface comprising an upper portion and a lower portion, said upper portion being housed within said gripping surface, said lower portion extending outwardly from said bottom side of said gripping surface.

3. The device of claim 2, further comprising said lower portion having a uniform length between said lateral sides of said gripping surface.

4. The device of claim 2, further comprising said upper portion having a top section and a bottom section, said top section being defined by an upper edge and a lower edge.

5. The device of claim 4, further comprising each of said upper and lower edges being parallel to said bottom side of said gripping surface.

6. The device of claim 4, further comprising each of said top and bottom sections being spaced from said front and back sides of said gripping surface.

7. The device of claim 6, further comprising said bottom section being spaced a greater distance from each of said front and back sides relative to said top section.

8. The device of claim 1, further comprising said perimeter wall of said gripping surface projecting outwardly a uniform distance around an entirety of said sponge surface.

9. An anti-microbial sponge device comprising:

a gripping surface, said gripping surface having a top side, a bottom side, and a perimeter wall extending between said top side and said bottom side, said perimeter wall comprising a front side opposite a back side, and a pair of opposed lateral sides extending between said front side and said back side, each of said lateral sides being concavely arcuate, each of said top side, said front side, and said back side being convexly arcuate, said gripping surface being translucent; and a sponge surface coupled to said gripping surface, said sponge surface comprising an upper portion and a lower portion, said upper portion being housed within said gripping surface, said lower portion extending outwardly from said bottom side of said gripping surface, said lower portion having a uniform length between said lateral sides of said gripping surface, said upper portion having a top section and a bottom section, said top section being defined by an upper edge and a lower edge, each of said upper and lower edges being parallel to said bottom side of said gripping surface, each of said top and bottom sections being spaced from said front and back sides of said gripping surface, said bottom section being spaced a greater distance from each of said front and back sides relative to said top section, said perimeter wall of said gripping surface projecting outwardly a uniform distance around an entirety of said sponge surface, said sponge surface comprising a porous material, said sponge surface being comprised of a non-absorbent material wherein said sponge surface is configured to resist an accumulation of microbial agents thereon.

* * * * *